US006196041B1

(12) United States Patent
Codatto

(10) Patent No.: US 6,196,041 B1
(45) Date of Patent: Mar. 6, 2001

(54) SHEET-METAL BENDING PRESS

(76) Inventor: Antonio Codatto, Via Enrico Fermi 17, I-36045 Lonigo (Vicenza) (IT)

( * ) Notice: Subject to any disclaimer, the term of this patent is extended or adjusted under 35 U.S.C. 154(b) by 0 days.

(21) Appl. No.: 09/402,924

(22) PCT Filed: Apr. 14, 1998

(86) PCT No.: PCT/EP90/02163

§ 371 Date: Dec. 14, 1999

§ 102(e) Date: Dec. 14, 1999

(87) PCT Pub. No.: WO98/46380

PCT Pub. Date: Oct. 22, 1998

(30) Foreign Application Priority Data

Apr. 15, 1997 (IT) ..... T097A0314

(51) Int. Cl.[7] ..... B21D 5/04
(52) U.S. Cl. ..... 72/323; 72/322
(58) Field of Search ..... 72/323, 319, 320, 72/306, 316

(56) References Cited

U.S. PATENT DOCUMENTS

| | | | | |
|---|---|---|---|---|
| 826,807 | * | 7/1906 | Slaysman | 72/323 |
| 2,422,042 | * | 6/1947 | Roberts | 72/319 |
| 4,411,148 | * | 10/1983 | Aschauer | 72/319 |
| 4,520,646 | | 6/1985 | Pauzin | 72/313 |
| 4,658,625 | * | 4/1987 | Koyama | 72/323 |
| 4,836,004 | | 6/1989 | Codatto | 72/323 |
| 4,843,862 | * | 7/1989 | Salvagnini | 72/323 |
| 4,944,176 | * | 7/1990 | Glorieux | 72/323 |
| 5,343,727 | | 9/1994 | Kabushiki et al. | 72/323 |

FOREIGN PATENT DOCUMENTS 42 06 417 9/1993 (DE) .

* cited by examiner

*Primary Examiner*—Daniel C. Crane
(74) *Attorney, Agent, or Firm*—Sughrue, Mion, Zinn, Macpeak & Seas, PLLC

(57) ABSTRACT

Guide means interposed between a blade-holder (20) and the frame (12) of a bending press comprise a slide (40) slidable along an axis (Z) perpendicular to the plane of the metal sheet (P) to be bent. The blade-holder (20) is coupled to the slide (40) so as to be slidable along an axis inclined to a plane perpendicular to the plane of the sheet (P). First means (38) for bringing about movements of the blade-holder (20) along the axis perpendicular to the plane of the sheet (P) are interposed between the frame (12) and the blade-holder (20). Second means for bringing about movements of the slide (40) along the inclined axis are interposed between the slide (40) and the blade-holder (20) in order to produce movements of the blade-holder (20) towards and away from the blank-holder (16, 18), parallel to the plane of the sheet (P). These movements can be brought about in preselected combinations, preferably under the control of a numerical-control device.

8 Claims, 4 Drawing Sheets

SHEET-METAL BENDING PRESS

This application is a 371 of PCT/EP98/02163, filed Apr. 14, 1998.

BACKGROUND OF THE INVENTION

The present invention relates to a sheet-metal bending press.

Arrangements are known from the documents U.S. Pat. Nos. 4,356,716 and 4,836,004.

Document U.S. Pat. No. 4,356,716 describes and illustrates a bending press in which a C-shaped blade-holder is mounted for pivoting angularly by means of a rear arm, about an eccentric pin. The angular bending strokes are imparted to the blade-holder by one or more actuators which in turn are carried by an eccentric pin.

Adjustment of the angular position of the eccentric pin of the actuators enables the stroke of the blade-holder to be adjusted in a direction substantially perpendicular to the plane of the metal sheet, according to the degree of closure of the angle to be imparted to the bend; adjustment of the angular position of the eccentric pin on which the arm of the blade-holder is mounted moves the blade-holder towards or away from the blank-holder according to the thickness of the sheet metal to be bent and/or the angle to be given to the bend.

This known arrangement has the disadvantage of causing the blades to work in less than ideal conditions since, given the angular pivoting of the blade-holder, the working blade never remains parallel to itself during the bending operation as would, however, be desirable.

U.S. Pat. No. 4,836,004 describes and illustrates a bending press in which a C-shaped blade-holder body is mounted for sliding to and fro along an axis perpendicular to the plane of the metal sheet and its rear cooperates with a cam surface a central portion of which extends along the perpendicular axis and which has end portions curved towards the blank-holder. By virtue of this arrangement, the blade always works parallel to itself during the bending operation and moves towards the blank-holder towards the end of this operation to a greater or lesser extent according to the length of the stroke imparted along the axis perpendicular to the plane of the metal sheet. This permits the formation of bends with angles which are closed to a greater or lesser extent. However, since the cam surface cannot be modified except by the replacement of the entire cam, the ideal bending conditions corresponding to a given cam exist only for sheet metal of a particular thickness.

SUMMARY OF THE INVENTION

The object of the invention is to provide a bending press of the type in question in which the blade always remains parallel to itself during the bending operation but can be moved towards and away from the blank-holder in accordance with a programme which takes account both of the thickness of the sheet metal to be bent and of other characteristics of the sheet metal, for example, its ductility.

According to the invention, this object is achieved by means of a bending press as disclosed.

By virtue to this concept, it is possible to produce a bending press which can perform an almost infinite number of bending programmes, that is, an almost infinite number of working strokes of the blade relative to the counter-blade, in dependence on the thickness and other characteristics of the sheet metal. During these strokes, the blade always remains parallel to itself by virtue of the fact that its composite movements take place in accordance with only two perpendicular components, of which one is parallel and the other is perpendicular to the plane of the metal sheet.

These programmes can advantageously be performed by means of numerically-controlled actuators placed under the control of a programmable numerical control unit.

BRIEF DESCRIPTION OF THE DRAWINGS

Further characteristics and advantages of the invention will become clear from a reading of the following detailed description, given by way of non-limiting example with reference to the appended drawings, in which.

DESCRIPTION OF THE INVENTION

Figure 1:
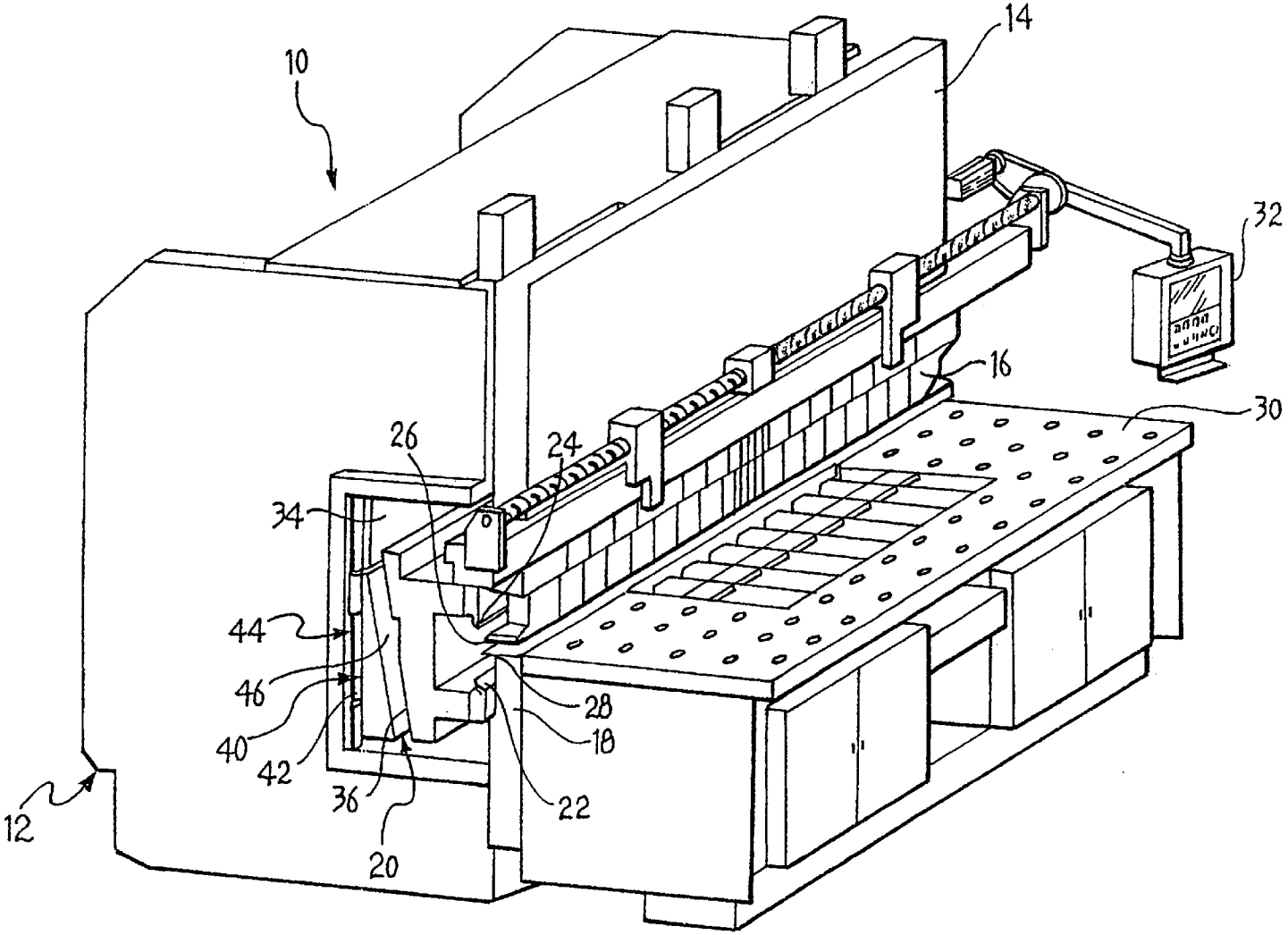
FIG. 1 is a schematic perspective view of a bending press incorporating the invention.

The embodiment shown in the drawings relates to the most common case of a press in which the movable blank-holder is the upper one, the fixed blank-holder is the lower one, and the plane of the metal sheet subjected to bending is horizontal.

The invention may, however, be applied to other arrangements such as, for example, an arrangement in which the movable blank-holder is the lower one, or an arrangement in which the plane of the metal sheet is vertical and the movable blank-holder moves horizontally.

With reference to FIG. 1, a vertical bending press, generally indicated 10, comprises a strong C-shaped frame, generally indicated 12.

A strong front plate 14 is slidable vertically on an upper front portion of the frame 12 and its lower portion carries an upper movable blank-holder 16 of the type composed of segments.

The details of the movable blank-holder 16 are described and illustrated in another International patent application filed by the Applicant on the same date for "A bending press for forming channel-shaped bends in the edges of a metal sheet", to which reference should be made. This other International patent application claims priority of Italian patent application No. TO97A000315 of Apr. 15, 1997.

Upward and downward vertical movements of the front plate 14 and of the blank-holder 16 are brought about by one or more hydraulic actuators, not shown.

A lower portion of the frame 12 carries a fixed blank-holder 18 with which the movable blank-holder 16 cooperates during bending operations.

A C-shaped blade-holder 20 is mounted in the cavity defined by the C-shaped frame 12 and carries a pair of bending blades, that is, a lower blade 22 and an upper blade 24.

In order to form bends, the lower blade 22 cooperates with a counter-blade 26 forming part of the upper movable blank-holder 16; the upper blade 24 cooperates, in order to form bends, with a counter-blade 28 forming part of the blank-holder 18.

The details of the actuating and guide members associated with the blade-holder 20 and of the bending operations will be described fully below.

On the front of the press 10 there is a table 30 for supporting metal sheets subjected to bending. The table 30 is preferably served by a manipulator (not shown).

All of the movements of the press and of its manipulator are preferably controlled by a numerical control device indicated conventionally by means of a suspended "console" 32 thereof.

Reference will now be made to FIGS. 2 and 4 to 7 to describe the guide and actuating means for the blade-holder 20. A portion of the guide means is also shown in FIG. 1.

In FIGS. 4 to 7, a rear wall of the frame 12 is indicated 34 and a rear face of the blade-holder facing the rear wall 34 is indicated 36.

As can be seen, the rear face 36 of the blade-holder 20 is inclined to the rear wall 34. This detail will be referred further below.

In FIGS. 4 to 7, a horizontal axis parallel to the horizontal plane of a metal sheet P clamped between the blank-holders 16 and 18 is indicated Y; a vertical axis perpendicular to the plane of the sheet P and the axis Y is indicated Z.

The blade-holder 20 is suspended on a pair of linear actuators 38, preferably hydraulic actuators, which in turn are suspended on the upper portion of the frame 12.

The actuators 38 are preferably numerically controlled and operated under the control of the numerical control device 32 in order to bring about movements of the blade-holder 20 in accordance with a first component and with a preselected travel parallel to the axis Z.

The means which, according to the invention, can bring about movements of the blade-holder 20 in accordance with a second component parallel to the axis Y in order to move the blade-holder towards and away from the blank-holders 16, 18 will now be described.

A slide, generally indicated 40, is interposed between the rear wall 34 of the frame 12 and the rear face 36 of the blade-holder 20.

The slide 40, which extends along the entire length of the blade-holder 20, is generally wedge-shaped with upwardly-converging opposed active faces. One of these faces, indicated 42, which is further from the blade-holder 20, is coupled to the rear wall 34 of the frame 12 by means of respective vertical guides 44 distributed along the blade-holder 20; the other face 46 of the slide 40 is coupled to the rear face 36 of the blade-holder 20 by means of respective sliding guides 48, which are also distributed along the blade-holder 20.

Each guide 44 is constituted by a vertical guide bar 50 fixed to the rear wall 34 and by a pair of sliding blocks 52 slidable along the bar 50 and fixed to the slide 40.

Moreover, each guide 48 is constituted by a pair of aligned bars 54 fixed to the oblique rear wall 36 of the blade-holder 20 along a line of maximum slope thereof, and by a pair of sliding blocks 56, each slidable along a respective bar 54.

Both the guides 44 and the guides 48 are preferably of a commercially available type with circulating rolling rollers or the like, for example, the circulating roller guides produced by W. Schneeberger AG of Roggwil, Switzerland.

Figure 3:
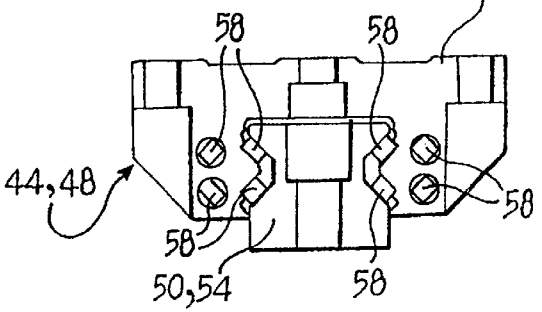
FIG. 3 is a cross-section of one of the guides shown in FIG. 2, FIGS. 4 and 5 are schematic side elevational views taken on the arrow IV of FIG. 1, showing two successive stages in the execution of a so-called positive bend.

The structure of these guides is shown in section in FIG. 3 which relates equally to a guide 44 or to a guide 48. Its guide bar is indicated 50, 54, and one of its sliding blocks is indicated 52, 56. The respective circulating sliding rollers are indicated 58.

The blade-holder 20 has a strong lower bracket-like appendage 60 which carries the cylinder of a fluid or electric linear actuator 62. The actuator 62 is preferably numerically controlled and operated under the control of the numerical control device 32 of FIG. 1.

The rod 64 of the actuator 62 extends parallel to the oblique guides 48 and is fixed to a lower face of the slide 40 in order to bring about the movements of the latter relative to the blade-holder 20 in the direction of the oblique guides 48.

Figure 2:
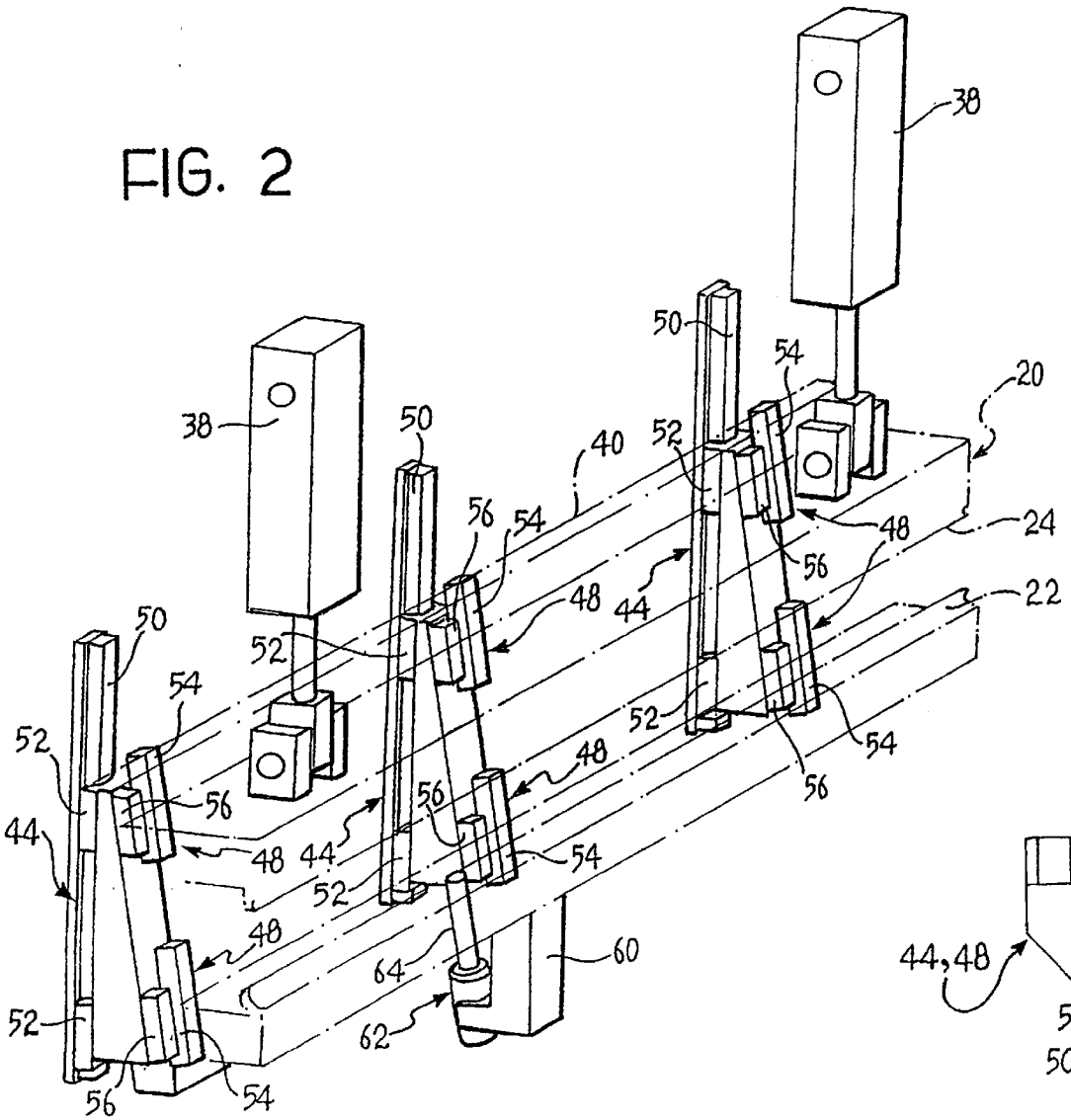
FIG. 2 is a schematic perspective view of the main internal members of the press with the blade-holder shown as if it were transparent.

Although FIG. 2 shows only one actuator 62, several actuators such as 62, working in unison and each associated with a guide unit 46, 48, could be provided.

As will be understood, upon the assumption that the actuator 62 is locked with the slide 40 in a certain position along the guides 48, if the actuators 38 are moved along the vertical axis Z, the entire unit comprising the blade-holder 20 and the wedge 40 is moved as a whole along the vertical guides 44 and the distance of the blades 22, 24 from the counter-blades 26, 28 along the Y axis remains unchanged.

If, on the other hand, the actuators 38 are locked and only the actuator 62 is operated, the wedge constituted by the slide 40 moves both along the vertical guides 44 and along the inclined guides 48, correspondingly changing the distance between the blades 22, 24 and the counter-blades 26, 28 along the Y axis.

The preferred angle $\alpha$ between the active faces 42, 46 of the unit formed by the slide 4 is of the order of 10°.

An angle $\alpha$ of this order of magnitude ensures optimal reversibility of the wedge preventing seizing of the guides 44, 48 and at the same time ensuring the correct proportions of the two components of the travel of the blade-holder 20 along the axes Y and Z.

Figure 5:
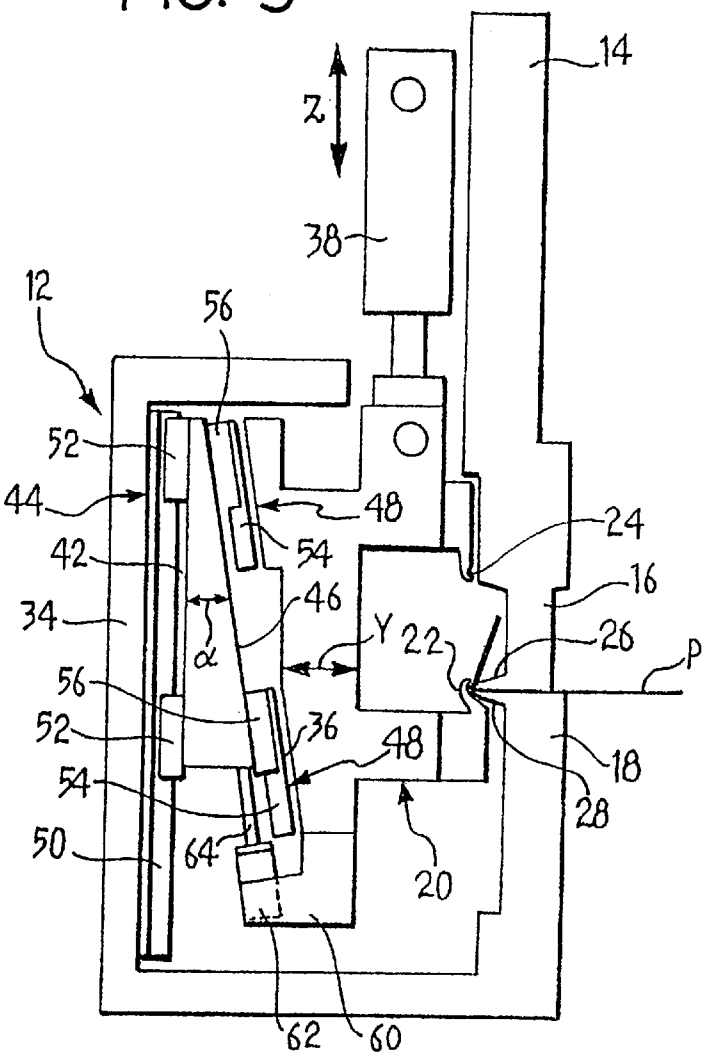
Figure 4:
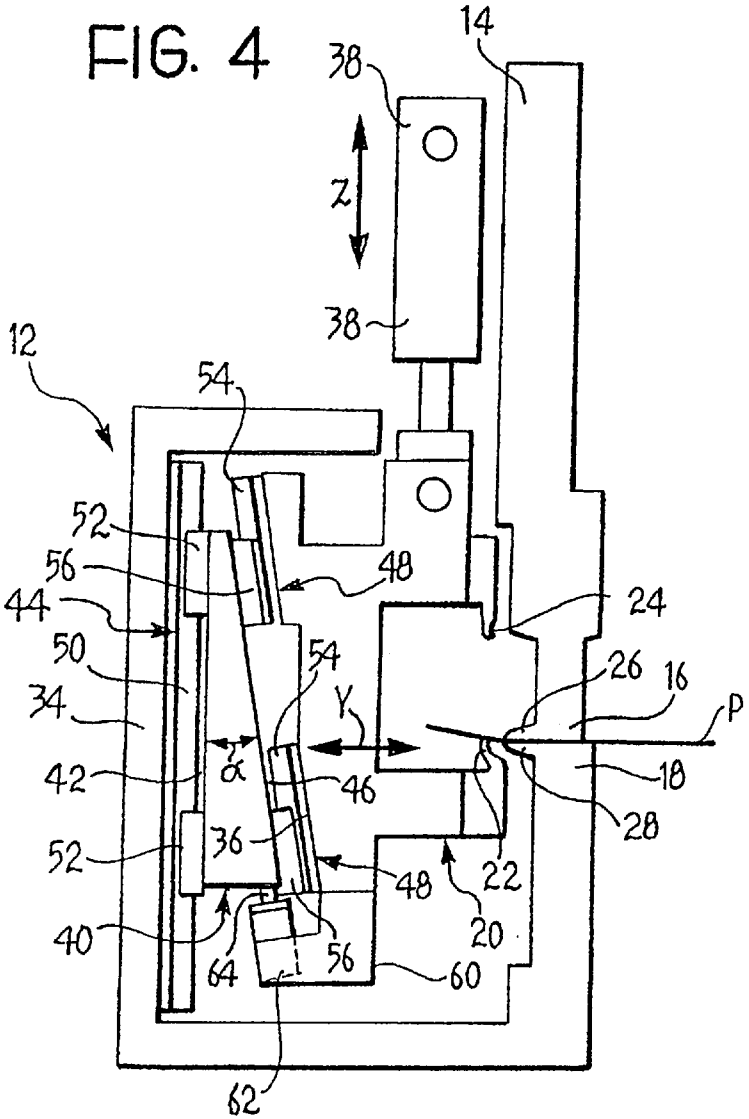
Figure 7:
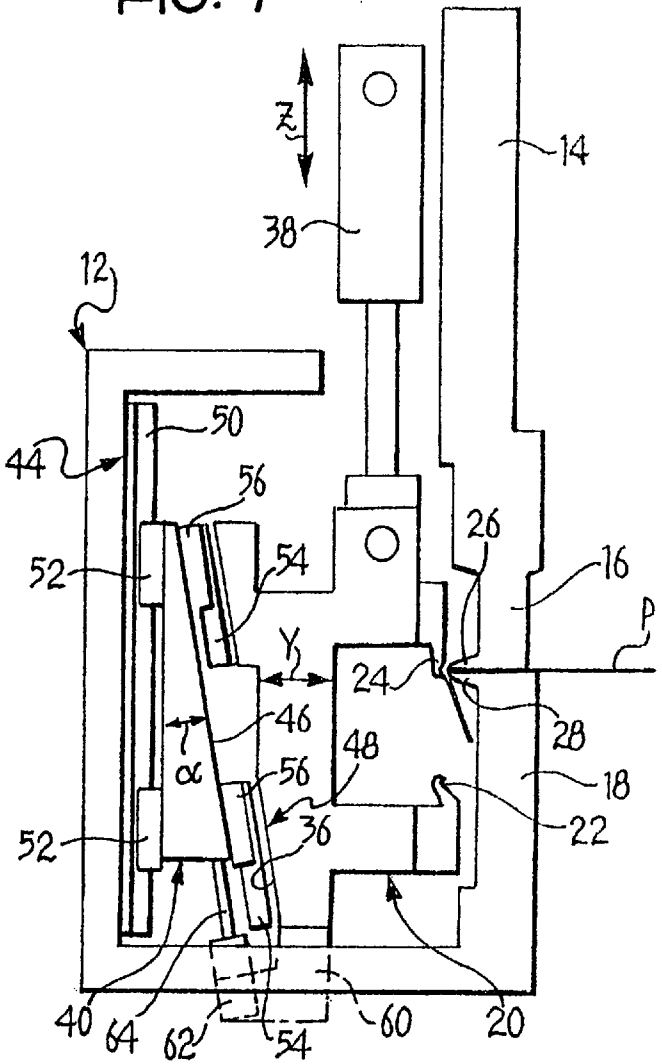
FIGS. 6 and 7 are schematic views similar to those of FIGS. 4 and 5, showing two successive stages of the execution of a so-called negative bend.
Figure 6:
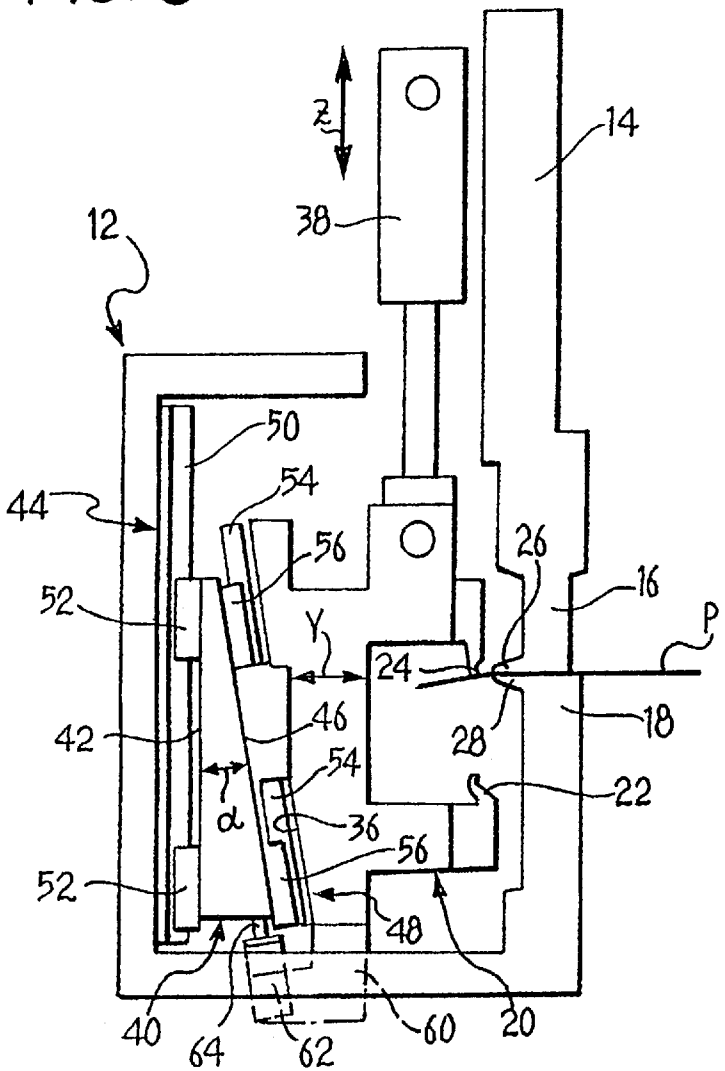

It is possible, on the basis of the numerical control device 32 (or an equivalent device), to programme a combination of movements along the axes Y and Z, on the one hand, to perform so-called positive bends, as in FIGS. 4 and 5, or so-called negative bends, as in FIGS. 6 and 7 and, on the other hand, to set a practically infinite number of different paths of the working blade 22 or 24 relative to the respective counter-blade 26 or 28, taking account of the angle to be imparted to a bend, as well as of the characteristics of the sheet metal such as its thickness and its ductility. In particular, in the case of a positive bend, it is possible to impart to the lower blade 22 a spiral path with a movement towards the centre in a clockwise direction with reference to FIGS. 4 and 5; in the case of a negative bend, it is possible to cause the upper blade 24 to follow a spiral path towards the centre in an anticlockwise direction with reference to FIGS. 6 and 7.

In any case, as will be understood, by virtue of the fact that the movement of the blade 22 or 24 has only two perpendicular components Y and Z, the blade always remains parallel to itself.

In FIG. 4, at the start of the formation of a positive bend, the slide 40 is in a fully-lowered position relative to the blade-holder 20 and the working blade 22 is at a maximum distance from the respective counter-blade 26. In FIG. 5, which shows the final stage of the formation of a positive bend with an acute angle, not only have the blade-holder 20 and its blade 22 been moved upwardly along the Z axis, but the slide 40 has also been moved upwardly relative to the blade-holder 20, consequently advancing the blade-holder 20 towards the blank-holders 16, 18 to a point at which the blade 22 is disposed practically on top of the counter-blade 26.

The blade 22 may have followed any suitable programmed path, including a spiral path, between the two conditions of FIGS. 4 and 5.

In FIG. 6, at the start of the formation of a negative bend, the slide 40 is again in a fully lowered position relative to the blade-holder 20 and, as before, the working blade 24 is at a maximum distance from the respective counter-blade 28. In FIG. 7, which shows the final stage of the formation of a negative bend with an acute angle, not only has the blade-holder 20 and its blade 24 been moved downwardly along the Z axis, but the slide 40 has also been moved upwardly again relative to the blade-holder 20, consequently advancing the blade-holder 20 towards the blank-holders 16, 18 to a point at which the blade 24 is disposed practically underneath the counter-blade 28.

In this case also the blade 24 may have followed any suitable programmed path, including a spiral path, between the two conditions of FIGS. 6 and 7.

Although a so-called double-acting bending press with two blade/counter-blade pairs for working selectively to form positive or negative bends has been described and illustrated, the invention may also be applied to a press having only one blade and only one counter-blade cooperating with one another.

What is claimed is:

1. A sheet-metal bending press comprising:

a substantially C-shaped frame (12) with a movable blank-holder (16) and a fixed blank-holder (18) cooperating to hold a metal sheet (P) to be bent, a blade-holder (20) movable in the frame and having at least one bending blade (22, 24), at least one counter-blade (26, 28) associated with one of the blank-holders (16, 18) and cooperating with the blade (22, 24), guide means (40) interposed between the blade-holder (20) and the frame (12) to enable the blade-holder (20) to perform a composite movement having a first component along an axis (Z) perpendicular to the plane of the metal sheet (P) held by the blank-holders and a second component towards and away from the blank-holders, and first and second actuating means (36, 62) for bringing about movements of the blade-holder (20) in accordance with a preselected combination of the first and second components and with preselected travel in the direction of these components, characterized in that:

the said guide means comprise a slide (40) which is slidable along the axis (Z) perpendicular to the plane of the metal sheet (P) and to which the blade-holder is coupled for sliding along an axis inclined to an axis (Y) contained in a plane perpendicular to the plane of the metal sheet (P), the first actuating means (38) are interposed between the frame (12) and the blade-holder (20), and the second actuating means (62) are interposed between the slide (40) and the blade-holder (20).

2. A bending press according to claim 1, characterized in that the slide (40) is generally wedge-shaped with opposed converging active faces of which the one (42) which is further from the blade-holder (20) is coupled to a rear wall (34) of the frame (12) by means of respective sliding guides (44) and the other (46) is coupled to a face of the blade-holder (20) facing the rear wall (34) by means of respective sliding guides (48).

3. A bending press according to claim 2, characterized in that the guides (44, 48) are of the type with circulating rolling members.

4. A bending press according to claim 2, characterized in that it comprises several guides (44, 48) distributed along the blade-holder (20).

5. A bending press according to claim 1, characterized in that the first and second actuating means are in the form of respective numerically-controlled linear actuators (38, 62) under the control of a programmable numerical control unit (32).

6. A bending press according to claim 1, characterized in that each of the blank-holders (16, 18) has a respective counter-blade (26, 28) and the blade-holder (20) has a pair of bending blades (22, 24) facing one another in a C-shaped arrangement.

7. A bending press according to claim 2, characterized in that the opposed active faces (42, 46) of the wedge-shaped slide (40) are inclined to one another at an angle ($\alpha$) of the order of 10°.

8. A bending press according to claim 1, characterized in that said bending press has an arrangement such that the plane of the metal sheet (P) is horizontal and the movable blank-holder (16) is the upper one.

* * * * *